US005531240A

United States Patent [19]

Kelada

[11] Patent Number: 5,531,240

[45] Date of Patent: Jul. 2, 1996

[54] METHOD AND APPARATUS FOR SPILL FREE LIQUID TRANSFER

[76] Inventor: Maher I. Kelada, 3711 Heather La., Pearland, Tex. 77581

[21] Appl. No.: 403,602

[22] Filed: Mar. 13, 1995

[51] Int. Cl.[6] ..... F04F 1/00

[52] U.S. Cl. ..... 137/15; 137/209; 137/240; 141/91

[58] Field of Search ..... 137/15, 209, 240; 141/91

[56] References Cited

U.S. PATENT DOCUMENTS

| | | | |
|---|---|---|---|
| 4,057,364 | 11/1977 | Bratschitsch | 417/34 |
| 4,150,700 | 4/1979 | Fox | 137/209 X |
| 4,169,225 | 9/1979 | Rickert et al. | 219/535 |
| 4,457,349 | 7/1984 | Vazin | 141/86 |
| 5,033,494 | 7/1991 | Harbolt et al. | 137/1 |
| 5,042,518 | 8/1991 | Singhe et al. | 137/2 |
| 5,069,244 | 12/1991 | Miyazaki et al. | 137/209 |
| 5,377,715 | 1/1995 | Andenmatten et al. | 137/209 X |

*Primary Examiner*—Gerald A. Michalsky
*Attorney, Agent, or Firm*—Russell J. Egan

[57] ABSTRACT

A liquid transfer method and apparatus has primary and secondary transfer lines, wherein the primary line carries fluid being moved from a supply container through a transfer assembly to a receiving container, and the secondary line carries pressurized inert gas to substantially purge liquid from the primary line. Pressurized gas is admitted into the system upon actuation of a liquid level sensing float valve in response to the liquid level in the transfer device. The pressurized gas actuates the closure of a valve on the primary line near the receiving container. The pressurized inert gas proceeds to force residual liquid out of the primary lines into the secondary lines and into the receiving container. Manual inspection and valve actuation is used to terminate gas flow and complete the purging process.

12 Claims, 3 Drawing Sheets

METHOD AND APPARATUS FOR SPILL FREE LIQUID TRANSFER

BACKGROUND OF THE INVENTION

1. The Field of the Invention

The present invention pertains to a method and apparatus for transferring liquids between containers and, in particular, to a transfer system which will result in substantially no spillage or adverse environmental effects when the system is disconnected after the transfer is completed.

2. The Prior Art

Transfer of liquids between vessels is a major continuing environmental problem, especially when one considers the large quantities of fluids, many of which may be hazardous, which are transferred on a daily basis. Not only should liquid transfers which occur in the normal routine of commerce be considered in this problem, but also the transfers that are required by industrial emergency situations which seem to arise on an almost daily basis. This would include accidents involving both barges and tank trailers as well as industrial plant accidents in which liquids must be removed from damaged vessels without creating an environmentally damaging situation. Thus it is important to have a spill free liquid transfer system which can have both fixed site embodiments as well as portable, embodiments which could be moved to the site of a required transfer. Either embodiment of the liquid transfer system should have the capability of operating in a hazardous environment, such as in the presence of volatile gases, without causing further potential danger by the use of possible spark generating equipment. Thus the preferred embodiments should rely on either a gas boosted flow or mechanically boosted flow by either a positive displacement pump, a fluid driven pump or a manual pump. The system should also be self purging of all liquid in the transfer lines after the termination of the liquid flow.

It is known to purge liquids from a fluid transfer system using pressurized gas and to force the purged liquids into secondary lines. The following references are representative of this art.

U.S. Pat. No. 5,033,494 to Harbolt et al. discloses a process for the volumetric transfer of liquids comprising the provision a supply 12, transfer tank 20 and drain conduit 36. Of particular interest is the incorporation of a compressed air source 22 and line 40 in such a manner as to purge the transfer tank and conduit of the transfer fluid. The line supplying the pressurized gas is independent of the primary drain conduit 32, but the back end of the gas purging system is conducted through the primary conduit 36, not through a secondary line.

U.S. Pat. No. 5,042,518 to Singhe et al. provides an apparatus and a method for draining fluid from a vacuum line by a drainage pipe having a one way valve permitting the flow of fluids away from the vacuum line and into the tank. A sensor detects a high level of fluid in a tank, thereupon actuating a three way valve to close the vacuum line entry into the tank and simultaneously open a pressurized gas line into the tank to force fluid therefrom. Fluid forced from the tank enters a purge line and a liquid collection line (column 2, lines 12–31)

Of lesser interest, U.S. Pat. No. 5,069,244 to Miyazaki et al. discloses a liquid source container device comprising a main supply 7, gas supply line 18 and delivery (drain) line 19, and several valves on the lines as shown in FIG. 2. The gas is purged from the delivery line by closing valves 20 and 21 and allowing pressurized gas to flow through the delivery line. This system does not entail the use of a secondary, independent line for either admitting gas or receiving residual fluid from a primary line.

Provided solely as background material, U.S. Pat. No. 4,169,225 to Rickert et al. discloses an electric heating apparatus with a system for automatically purging an enclosed volume therein. The actuation method senses low pressure conditions and purging gas is thereupon admitted to the enclosure. The purge gas is not used to force fluids from drainage lines, however.

OBJECTS OF THE INVENTION

The present invention provides for both a portable or a fixed system to safely transfer regulated and environmentally hazardous liquids (flammable, toxic, organic, etc.), in normal circumstances as well as in the case of emergencies, from top or bottom connections of a source container, pipe or equipment which is under elevated or atmospheric pressure, is at, above or below grade, to a receiving vessel without retaining liquid in connecting pipes that may result in a spill and contaminate the environment when the pipes are disconnected.

The method of the present invention has application to both portable and fixed embodiments, either of which will safely transfer regulated and environmentally hazardous liquids (flammable, toxic, organic, etc.) in both normal circumstances as well as in cases of emergency from a source container, pipe or equipment to a receiving container or vessel without retaining liquid in any of the necessary connecting pipes that may result in a spill and contaminate the environment when the pipes are disconnected.

Another consideration of the present invention, in addition to preventing spillage, is preventing the unnecessary use of pressurized purging gas. The purging gas might be subject to a vapor recovery process and excessive amounts of gas might tend to unnecessarily overload such a system. Further, excessive amounts of purging gas in the system might blast into the recovered liquid causing splashing and possible spillage from the receiving vessel. The present invention is able to control the amount of purging gas utilized by having primary and secondary lines with the secondary lines having a far smaller capacity than the primary lines.

The present invention has the further advantage of being adapted for either fixed installation or as a portable unit which could range from vehicle mounted size to a truly portable hand carried unit. The present invention is also preferably gas operated, but could be entirely manually operated if conditions warranted.

The present invention would be particularly useful in the situation in which a rail tank car, which is normally top loaded and bottom unloaded, derails and must to be emptied to avoid a spill and enable clearing the wreckage from the site. If the bottom unloading means of the tank car are available after the derailment, possibly the tank car could be drained in a fairly convention manner. However, if the normal bottom draining means is not available, due to the position of the derailed tank car or if the tank car is significantly lower than the receiving vessel, the present invention would still be able to drain the source vessel into the receiving vessel. Many of the available transfer devices would not be capable of handling this situation.

SUMMARY OF THE INVENTION

The present invention is a liquid transfer method and apparatus which has an unloading line, a transfer assembly connected to the unloading line, a loading line connected to the transfer assembly, and a pressurized gas source connected to both lines and controlled by the transfer assembly. Both the unloading line and the loading line have primary and secondary transfer pipes, wherein the primary pipe carries fluid being moved from a source container to a receiving container and the secondary pipe carries pressurized gas to substantially purge liquid from the primary line into the receiving container at the end of liquid flow. The secondary lines are significantly smaller in capacity than the primary lines. Pressurized gas is admitted into the system upon detection of liquid level in the transfer assembly. The pressurized gas actuates closure of a valve in the loading line primary pipe near the receiving container. The pressurized gas proceeds to force residual liquid out of the primary lines, into the secondary lines, into the delivery end portion of the loading line primary pipe, and into the receiving container. Manual inspection and valve actuation are used to determine pressurized gas flow and complete the purging process.

The present invention allows only liquid to transfer. Towards the end of a liquid transfer cycle, a transfer assembly shuts off liquid flow as the liquid level falls within a float chamber in the transfer assembly. As the level of the liquid being transferred continues to fall, it drains from the system through spring loaded check drainers, a level switch is activated allowing pressurized gas to flow to a pneumatic actuator and close a valve in the loading or delivery line. As the pressure of the gas builds up in the system, gas will flow through a spring loaded check valve near the end of the loading line displacing the liquid trapped in the line and discharging it through the secondary pipe to the receiving container. Finally all liquid in the system is displaced with gas. A sight glass provides visual indication of gas and liquid movement.

BRIEF DESCRIPTION OF THE DRAWINGS

The present invention will now be described, by way of example, with reference to the accompanying drawings, in which.

DETAILED DESCRIPTION OF THE PREFERRED EMBODIMENTS

The subject invention is intended to safely and completely transfer liquids from a first pressurized or unpressurized source container to a second receiving container at a lower pressure or at atmospheric conditions. The containers can be at, above or below grade and the source container can be emptied from either the top of the bottom. The invention is designed to empty itself without leaving any significant amount of liquid in the connecting unloading and loading pipes. It will also prevent flowing of pressurized gas to the receiving container, which could cause liquid to splash therefrom. No spills will occur on disconnecting pipes, after the liquid transfer is completed, as is often the case with conventional liquid transfer systems which employ either gas pading transfer, pumping, or gravity drain. The present invention is adaptable for both portable or fixed installations and is particularly suitable for use in hazardous environments.

Figure 1:
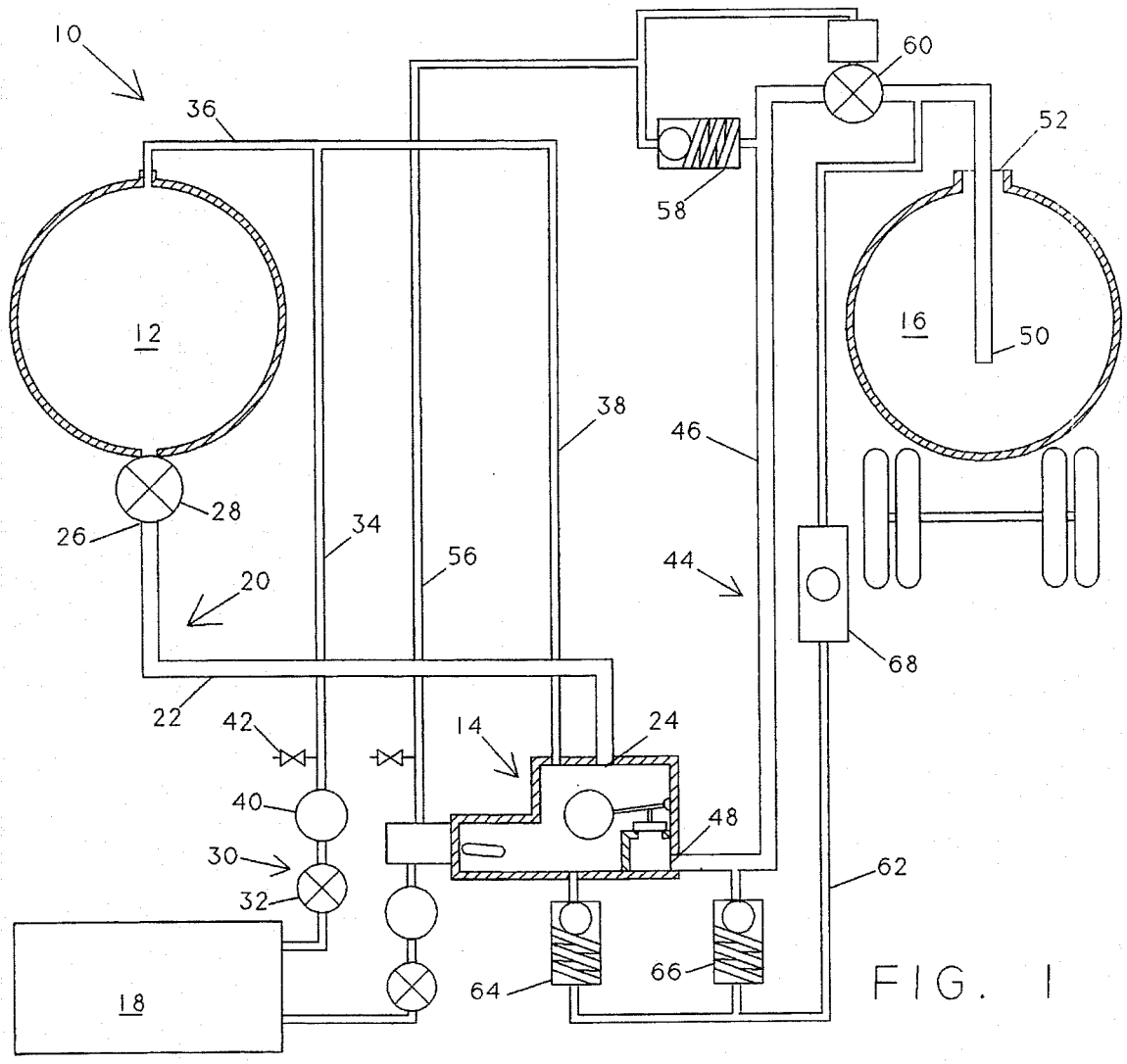
FIG 1 is a schematic elevation of a bottom unloading embodiment of the subject invention.

Turning now to FIG. 1, the bottom unloading embodiment of the subject invention 10 has a liquid source container 12, a transfer assembly 14, a receiving container 16, and a source of pressurized gas 18. Both the source and receiving containers 12, 16 are shown as if they are at atmospheric pressure, although the present invention can function with the source container pressurized and the receiving container at atmospheric conditions. An articulated unloading arm assembly 20 has a primary unloading line 22 with its first end 24 connected to the transfer mechanism 14 and its other end 26 operable to engage the drain valve 28 on the source container 12. A secondary unloading line 30 connects the source of inert gas 18, through valve 32 and lines 34 and 36 to the source container 12 and to transfer assembly 14 through line 38. The secondary unloading line 30 also includes known pressure regulation means 40 and venting means 42. A somewhat similar articulated loading arm assembly 44 has a primary loading line 46 with its first end 48 connected to the transfer assembly 14 and its other end 50 operable to be received in the inlet 52 of the receiving container 16, here schematically shown as a tank truck. The loading arm assembly 44 also has a secondary loading line 56 which connects the pressurized gas source 18 to the primary loading line 46, near receiving container 16, through secondary line 56 and spring check drainer 58, and to fluid actuated valve 60. A further secondary loading line 62 is connected at one end to the transfer assembly 14 and the first end 48 of the primary loading line 46 through spring loaded drainer valves 64 and 66, respectively. This secondary loading line 62 is provided, intermediate its ends, with a sight glass 68 and its other end is connected to the primary loading line 46 downstream of the fluid actuated valve 60.

Figure 2:
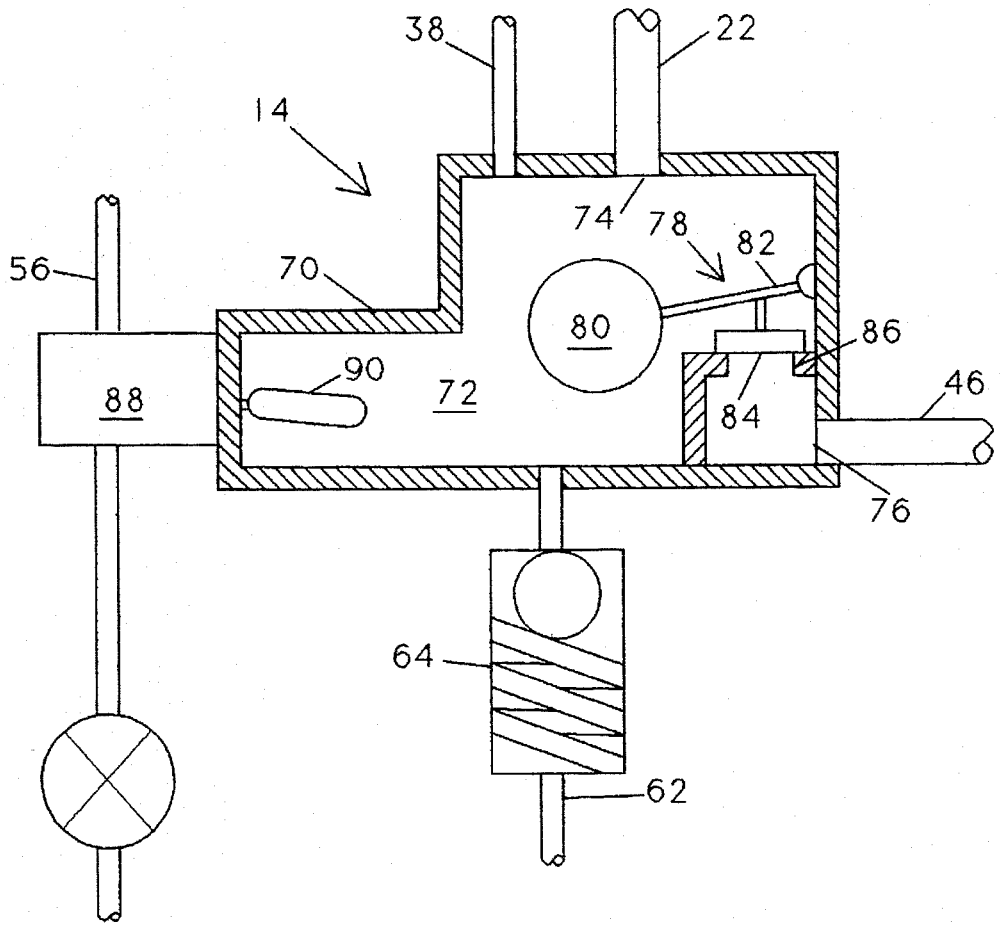
FIG. 2 is a detailed schematic longitudinal section through the transfer assembly shown in FIGS. 1 and 3.

The transfer assembly 14 is shown in somewhat greater detail in FIG. 2 and includes a closed housing 70 defining a chamber 72 having a liquid inlet 74 and a liquid outlet 76. A first float valve assembly 78 controls the outlet 76. The first float valve assembly 78 consists of a float 80, preferably formed from high alloy steel so as to be non-corrosive, connected by a lever mechanism 82 to move a valve body 84 with respect to a valve seat 86. A second float controlled valve 88 has its float 90 in the chamber 72 and the valve is connected to control the flow of pressurized gas from the source 18 through secondary line 56.

Top unloading source containers, fitted with dip pipes, can be unloaded in a somewhat similar fashion.

The pressurized gas used in the subject system is preferably an inert gas such as nitrogen, which is both inert and relatively inexpensive. However, other gases and/or combinations of gases, such as air, can be used if the liquid being transferred and the situation warrants.

The system is initially on stand by with all pressurized gas supply lines closed and the discharge valve on unloading arm open. To start a transfer sequence, the articulated transfer arms or piping and the equalizing lines are connected to the respective containers. Gravity flow condition between the container to be emptied and the transfer assembly has to either be maintained or pumping means added to cause liquid flow. The bottom drain valve on the container to be emptied is opened allowing the transfer assembly to gradually to fill with liquid. Both the floats in the transfer assembly will rise actuating their respective valves. The container to be unloaded is gradually pressurized with gas, provided the container is capable of withstanding positive pressure. Otherwise, a positive displacement fluid actuated pump is engaged to sustain liquid transfer. Liquid transfer starts and will continue until the liquid level in the float chamber of the transfer assembly starts falling. The system will automatically shut down as low liquid level in this chamber is reached. The pressurized gas will cause the fluid actuated valve on the loading arm to close. The system will continue draining under the influence of the purging gas flowing through the source container and the primary lines of the apparatus. The sight glass will indicate the end of the transfer, when its float ceases to fluctuate. The pressurized gas supply is closed off and the system will gradually vent until the pressure stabilizes and all piping can be disconnected.

This bottom unloading embodiment works in the following manner. When the drain valve 28 is opened, liquid will flow by gravity from source container 12 through primary unloading line 22 into the transfer assembly 14. At substantially the same time, the valve 32 is opened to admit pressurized gas from supply 18 to secondary unloading lines 34, 36, 38, and into container 12 and transfer assembly 14. The first float valve assembly 78 opens when the liquid level in the chamber 72 rises sufficiently, allowing the liquid to drain therefrom through outlet 76. The first float valve assembly 78 closes the outlet 76 when a low liquid level is reached towards the end of the liquid transfer cycle. The second float valve assembly 88 controls the pressurized gas flow to the unloading lines in similar fashion. A high liquid level in the chamber 72 causes the pressurized gas valve 88 to close shutting off the flow of gas from supply 18 and exhausts the secondary loading line 56 to atmosphere. When a low liquid level in chamber 72 is reached, the valve 78 closes outlet 76 and valve 88 closes an exhaust port (not shown) and opens a supply port (also not shown) so that the pressurized gas flows from supply 18 into secondary loading line 56. The pressurized gas in lines 34, 36, and 38 will drive residual liquid from container 12 into primary unloading line 22 and into transfer assembly 14. Here the residual liquid will be collected and forced through spring loaded drain valve 64 into secondary line 62. The pressurized gas in the secondary loading line 56 will also cause fluid actuated valve 60 to close and pressurize primary loading line 46 through spring valve 58 to drive the liquid in the primary loading line 46 through to spring loaded valve 66, through secondary loading line 62 into the receiving container 16. The sight glass 68 allows visual observation of the completion of the draining operation.

Figure 4:
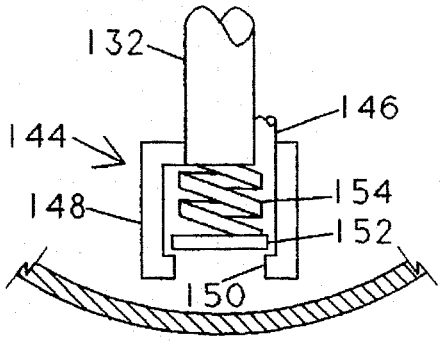
FIG. 4 is a detailed schematic longitudinal section through a typical spring valve of the type used in the top unloading embodiment.
Figure 3:
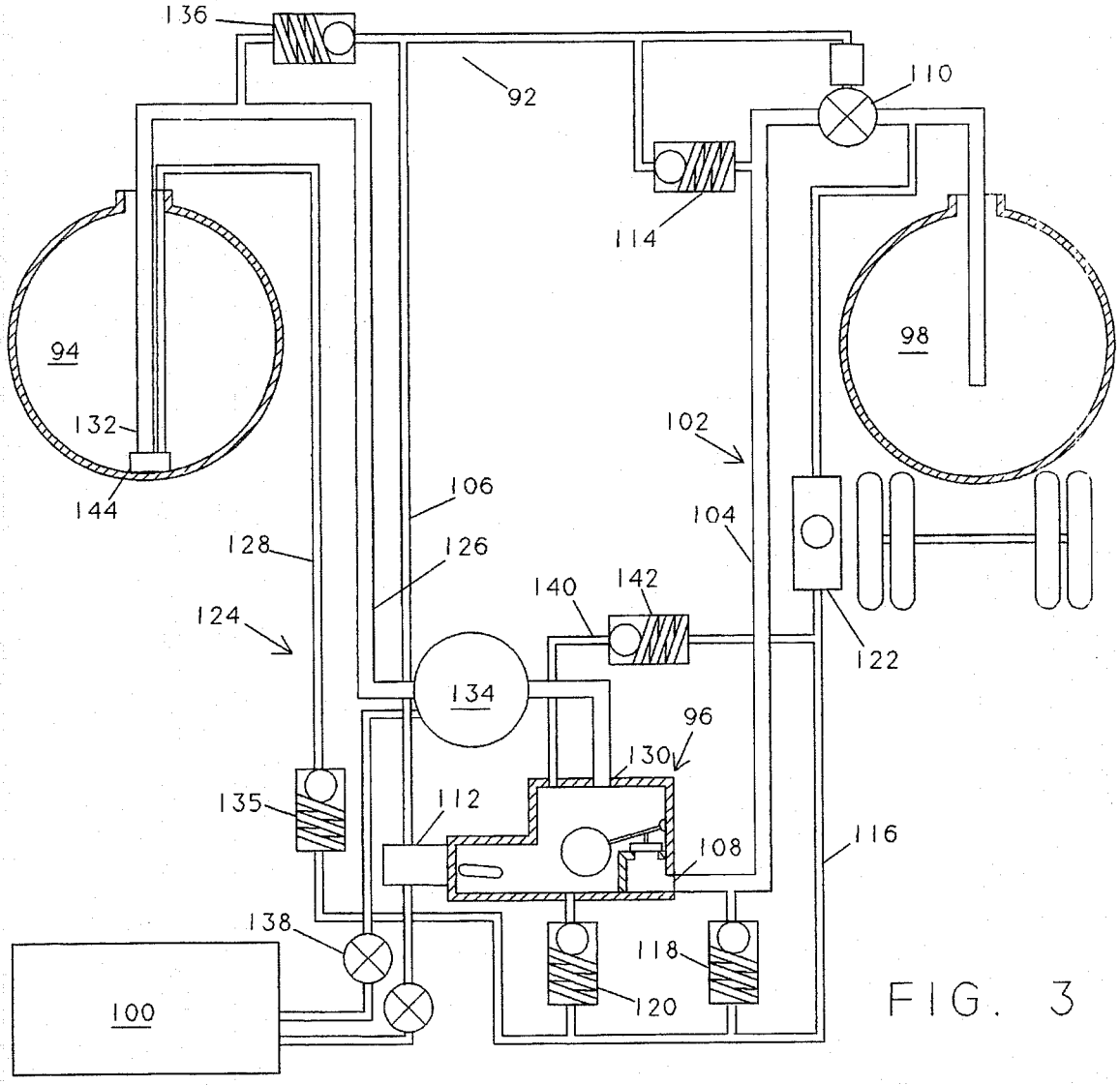
FIG. 3 is a schematic elevation, similar to FIG. 1, of a top unloading embodiment of the subject invention.

The alternate or top unloading embodiment of the present invention, illustrated in FIG. 3, differs from the above described primary or bottom unloading embodiment in that it is provided with pumping means. This embodiment 92 of the subject invention has a liquid source container 94, a transfer assembly 96, a receiving container 98, and a source of pressurized gas 100. The transfer assembly 96 is substantially the same as that in the above described bottom unloading embodiment. Both the source and receiving containers, as with the first embodiment, are shown at atmospheric pressure and the gas source 100 is pressurized. The articulated loading arm assembly 102 is substantially the same as that of the above described bottom unloading embodiment in that is has primary and secondary lines 104, 106. The first end 108 of primary line 104 is connected to the transfer assembly 96 and a fluid actuated outlet valve 110 is connected upstream of its outlet end which is received in the container 98. The secondary line 106 connects the source of pressurized gas 100, through control valve 112 and spring loaded drain valve 114, to the primary loading line 104 up stream of the valve 110. A second secondary line 116 has one end connected to the primary line 104 downstream of valve 110 and its other end connected, through spring check valves 118 and 120 to the end 108 of primary line 104 and transfer assembly 96, respectively. A sight glass 122 is mounted in second secondary line 116 and serves the same purpose as described above for the bottom unloading embodiment. Thus far this top unloading embodiment is substantially the same as the previously discussed bottom unloading embodiment. The primary differences between the embodiments comes in the articulated unloading arm assembly 124. There are primary line 126 and secondary line 128. The first end 130 of primary line 126 is connected to the transfer assembly 96 and the opposite end 132 depends to the bottom of the source container 94. Pumping means 134 are included in the primary line 126. Preferably the pumping means 134 is a positive displacement fluid actuated pump, such as a double diaphragm pump, although almost any pump including a manually operated pump could also be used. If there is a significant volume of liquid to be moved, and/or speed of liquid transfer is important, then other types of pumping means, such as a centrifugal pump driven by an air motor, could be used. The secondary line 128 connects source container 94 to the loading secondary line 116 through spring valve 135. Secondary line 106 is connected to primary unloading line 126 through spring valve 136. A further line 138 connects the pressurized gas source 100 to the gas driven pump 134. Another secondary line 140 connects the transfer assembly 96 to the loading primary line 104, through spring valve 142, to permit the transfer assembly to vent as it fills with liquid. A valve assembly 144 (see FIG. 4) is received on the ends 132 and 146 of the primary and secondary lines 126 and 128, respectively. The valve assembly 144 includes a valve housing 148, a valve seat 150 within the housing, a valve member 152, and spring means 154 biasing the valve member 152 towards the seat 150

The operation of this embodiment is similar to that of the previously described embodiment. The appropriate valves would be opened and the pumping means energized to start the flow of liquid from the source container into the transfer assembly. As long as the liquid continues to flow, the operation of the two embodiments is the same. When the liquid ceases to flow in this embodiment, the pump is shut down and the liquid drained from the lines as before.

Figure 5:
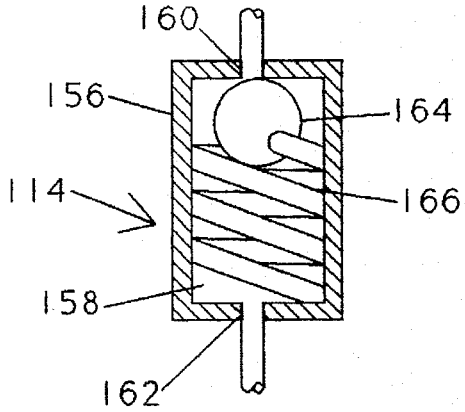
FIG. 5 is a detailed schematic longitudinal section through a typical relief valve of the type used in draining the primary pipe of both embodiments.

One of the spring loaded drain valves 114 is shown in greater detail in FIG. 5. This representative valve has a housing 156 defining a chamber 158 with an inlet 160 or valve seat, an outlet 162, a movable valve member 164 (here shown as a ball) and a spring 166 biasing the valve member against the seat. This simple valve clearly can be adapted to open at almost any desired pressure. Valves of this type would be, appropriately connected in the subject system to assure drainage of all lines.

Both embodiments would have the normal features of valves, gauges, and vents. While some of these features have been shown, not all that would normally be included have been shown or described for the sake of clarity of the drawings. Such features are well known and the skilled artisan would include them when and where they are necessary.

It is within the scope of the present invention to use the second embodiment in a bottom unloading situation. The pump means would used to at least prime the system and then could be shut down or left running as desired.

It is also within the scope of the present invention to have manually operated pumping means, as previously mentioned, which may be a distinct advantage should it be necessary to remove liquid from a damaged vehicle where there are possible both environmental dangers as well as dangerous fumes from the liquid being transferred. Further, a manually operated system could be used in situations where power might not be available, for example after a storm.

Both embodiments have been described with reference to using an inert gas, such as nitrogen, as the driving or purging gas. While this may be the preferred gas, it is not to be considered as the only gas which would be suitable for use in the present invention. The choice of gases would largely be dependent upon the liquid being transferred. Air might be suitable in some cases while an inert gas required in other cases.

While the primary and secondary lines have been shown separate for sake of illustration, it is within the scope of the invention to have the secondary lines within the, primary lines or have the lines attached.

The present invention may be subject to many modifications and changes without departing from the spirit or essential characteristics thereof. The present embodiments are therefor to be considered in all respects as illustrative and not restrictive of the scope of the invention as defined by the appended claims.

We claim:

1. In a liquid transfer mechanism having a liquid source, a liquid receiver, a source of pressurized gas, and a transfer mechanism, the improvement characterized by:

an unloading arm assembly having primary and secondary flow lines with one end of said arm assembly connected to said source container and the other end connected to said transfer assembly;

a loading arm assembly having primary and secondary flow lines with one end of said arm assembly connected to said receiving container and the other end connected to said transfer assembly;

said transfer assembly comprising housing means defining therein a chamber having an inlet and an outlet, both of which are connected to the unloading and loading primary lines, respectively; first and second float valve means in said chamber one of which controls flow of liquid through the chamber and the other of which controls flow of pressurized gas into the secondary lines, whereby when the liquid level drops sufficiently the first float valve closes off liquid flow to the loading primary line and the second float valve initiates pressurized gas flow to pressurize in the secondary line and purge liquid in the primary line into the secondary line and into the liquid receiver.

2. A liquid transfer apparatus for transferring liquids between a source vessel and a receiving vessel in an environmentally safe and spill free manner, said apparatus comprising:

a transfer assembly having housing means defining therein a chamber containing first and second valve means one of which controls flow of liquid through the chamber and the other of which controls flow of pressurized gas;

a pressurized gas source;

unloading line means connected between said transfer assembly and said source vessel;

loading line means connected between said receiving vessel and said transfer assembly, whereby liquid in the source vessel is flowed from the source vessel, through the unloading fine means through the transfer assembly, and through the loading line means to the receiving vessel wherein when the liquid level drops sufficiently in said transfer means the first valve closes off liquid flow to the loading line and the second valve initiates pressurized gas flow to purge liquid into the receiving vessel.

3. A liquid transfer apparatus according to claim 2 wherein:

said unloading line means comprises a primary line connected between said transfer assembly and said source vessel and secondary line means connected between said pressurized gas source and said source vessel;

said loading line means comprises a primary line connected between said receiving vessel and said transfer assembly and a secondary line connected between said pressurized gas source and said primary line adjacent said receiving vessel; and further comprising a plurality of spring loaded drain check valves connecting said primary lines to said respective secondary lines whereby, at the end of liquid flow in the primary lines, gas from said secondary lines is flowed through said primary line to purge the liquid therefrom into the secondary lines and into said receiving vessel.

4. The apparatus according to claim 3 wherein said source vessel is bottom unloading.

5. The apparatus according to claim 3 wherein said source vessel is top unloading, further comprising:

pump means in said primary unloading line.

6. The apparatus according to claim 5 wherein said pump means is gas driven.

7. The apparatus according to claim 5 wherein said pump means is manually operated.

8. The apparatus according to claim 3 wherein said pressurized gas is an inert gas.

9. The apparatus according to claim 8 wherein said pressurized gas in nitrogen.

10. A method for transferring liquid from a source vessel to a receiving vessel, said method comprising the steps of:

providing a transfer assembly;

providing a source of pressurized gas;

providing unloading line means having a primary line and a secondary line, one end of each line being operatively connected to said source vessel and the other end of said lines being connected to said transfer assembly and said pressurized gas source, respectively;

providing loading line means having a primary line and a secondary line, one end of each line being operatively connected to said source vessel and the other end of said lines being connected to said transfer assembly and said pressurized gas source, respectively;

flowing said liquid from said source vessel through said primary unloading line to said transfer assembly, through said transfer assembly and said loading lines to said receiving vessel;

sensing cessation of liquid flow through said transfer assembly to close off valve means adjacent a discharge end of said unloading primary line while opening valve means to fill said secondary lines with said pressurized gas and drive liquid from said primary lines into said secondary lines and into said receiving vessel.

11. The method according to claim 10 wherein said source vessel is top unloading, further comprising the step of:

providing pumping means in said unloading primary line whereby liquid is caused to flow from said source vessel.

12. A liquid transfer system comprising:

a vessel to be emptied;

a vessel to receive transferred liquid;

unloading line means having a primary line and a secondary line;

pump means in said unloading primary line;

loading line means having a primary line and a secondary line;

a transfer assembly adapted to receive liquid therein from said primary unloading line through said pump means and control first and second valves in response to liquid level therein, one of said valves controlling liquid flow through said transfer assembly and the other of said valves controlling flow of inert gas into said secondary lines.

* * * * *